United States Patent [19]

Lambot

[11] 4,418,770

[45] Dec. 6, 1983

[54] PROCESS FOR RETRIEVING A CORING BARREL COMPRISING TWO TUBES AND RETRIEVING DEVICE FOR SUCH A PROCESS

[75] Inventor: Honore J. Lambot, Wauthier-Braine, Belgium

[73] Assignee: Societe Anonyme Diamant Boart, Brussels, Belgium

[21] Appl. No.: 322,130

[22] Filed: Nov. 17, 1981

[30] Foreign Application Priority Data

Nov. 21, 1980 [EP] European Pat. Off. ..... 80201101.5

[51] Int. Cl.[3] ..... E21B 49/00

[52] U.S. Cl. ..... 175/58; 175/246; 166/217; 294/86.24

[58] Field of Search ..... 175/58, 246–248, 175/317–318; 166/217, 326; 294/86.24, 86.25

[56] References Cited

U.S. PATENT DOCUMENTS 2,656,151 10/1953 Miller ..... 175/318
2,857,138 10/1958 Svendsen et al. ..... 175/317
3,340,939 9/1967 Lindelof ..... 175/246
4,187,919 2/1980 Lambot ..... 175/246

*Primary Examiner*—Ernest R. Purser
*Assistant Examiner*—Thuy M. Bui
*Attorney, Agent, or Firm*—Sughrue, Mion, Zinn, Macpeak and Seas

[57] ABSTRACT

An inner tube 2 of a core barrel is releasably locked within an outer tube 1 by pivotable latch feet 32 engaging an annular recess 31 in the outer tube. A retrieving head 3 is slidably coupled via a pin 40 and slot 41 to the inner tube, and carries sealing rings 6 disposed, during coring, within a recess 5 in the outer tube to permit fluid passage. To retrieve a core sample in an ascending boring the pressure in the lower part of the column is reduced, whereupon the retrieving head drops by gravity to seal off the outer tube. A pin 37 on the inner tube then drops to cam release the latch feet and unlock the inner tube from the outer tube. Thereafter, as the lower column is drained, the inner tube and retained core sample descend by gravity down through the outer tube to a retrieval site.

9 Claims, 8 Drawing Figures

2
35
1
37
33
39
7
34
32
36
38
40
8
41
6
25
10
42
43
23

2
1
4
7
36
8
12
27
5
6
25
3
15
10
26
13
11
14
16
18
24
19
17
22
20
28
23
1

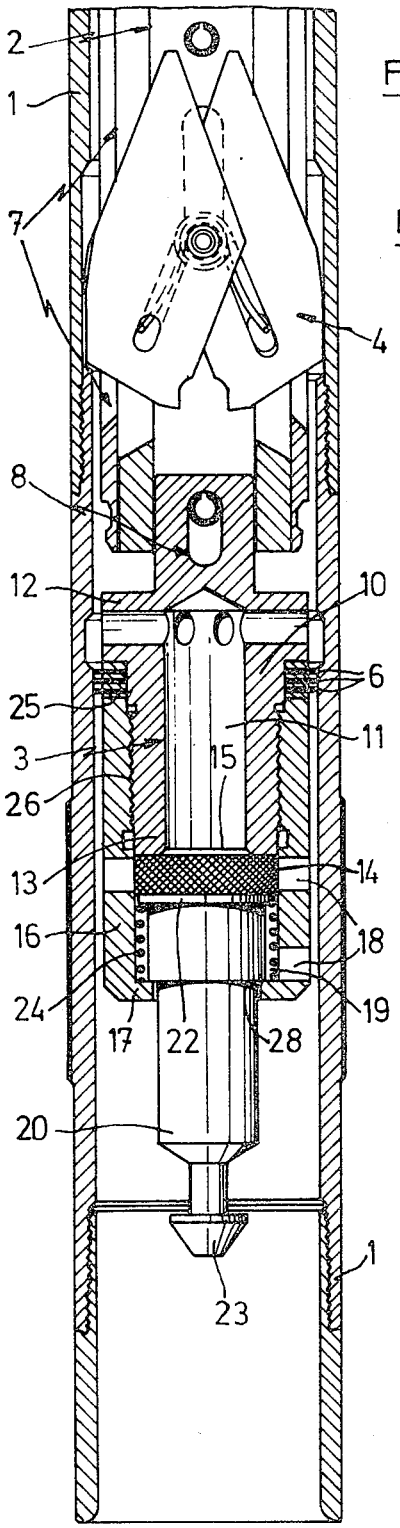
FIG. 5
FIG. 6
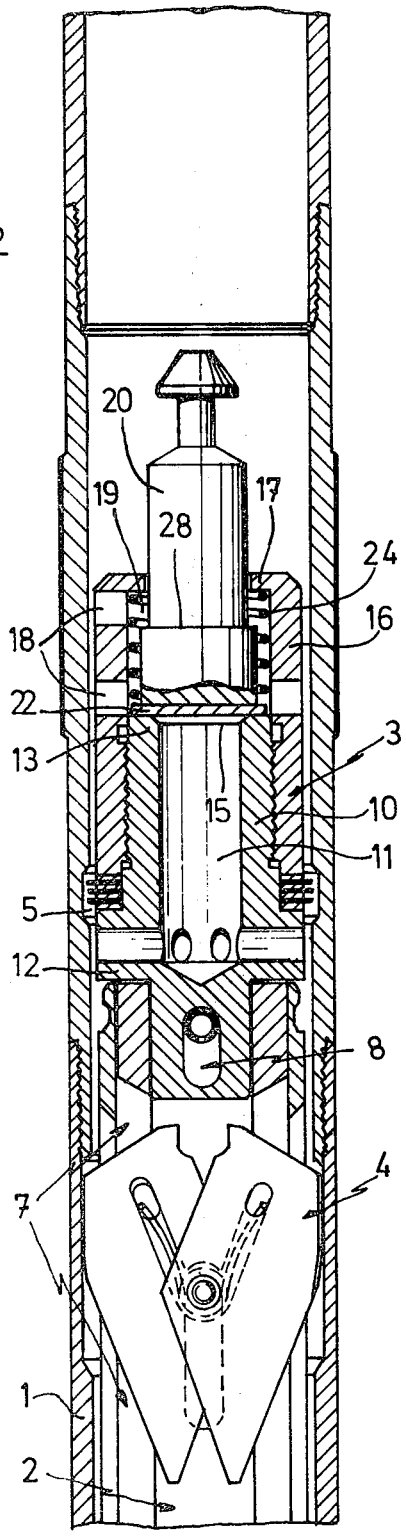

PROCESS FOR RETRIEVING A CORING BARREL COMPRISING TWO TUBES AND RETRIEVING DEVICE FOR SUCH A PROCESS

FIELD OF THE INVENTION

This invention relates to a process for retrieving a coring barrel comprising two tubes, used in the presence of a boring liquid, as well as a retrieving device for such a process.

The process according to the invention allows particularly the retrieval or recovery, during a rising or ascending boring, of a coring apparatus or barrel comprising an inner tube which may slide within an outer tube. The inner tube comprises a set of hollow rods provided, at one end, with a core extracting sleeve and, at the other end, with a head. The outer tube comprises a set of hollow rods, provided at one end with a drilling crown. The head of the inner tube has a suspension stop and locking means engaged, in the boring position, in an annular notch for locking the outer tube, the inner tube having, from its upper end to its lower end, within the outer tube, a passage for enabling the flow of the boring liquid toward the drilling crown.

The device according to the invention is specifically adapted for said process for retrieving the core barrel during a rising boring, said device being however also useful for retrieving the same core barrel during a substantially horizontal or descending boring.

Double tube coring barrels are presently widely used in all types of boring, for example in descending borings for mine, petroleum or geothermal prospection, or in horizontal or ascending borings for drillings in underground working.

PRIOR ART

Such coring apparatus are widely described in the technical literature particularly in the U.S. Pat. Nos. 2,656,151; 3,340,939 and 4,187,919. A known coring apparatus comprises two coaxial tubes, in which the inner tube may be locked into the outer tube and may be unlocked and brought back to the surface through the outer tube, by means of a cable, a retrieving element called "overshot" and an auxiliary winch, whereas the outer tube carrying the drilling crown remains in the drilled hole.

Generally, the coring is effected, both in a descending boring and in an ascending boring, in the presence of boring liquid injected by means of a pump toward the drilling or boring crown carried by the free end of the inner tube or set of hollow rods, through an annular space between the inner set of rods (inner tube) and the outer set of rods (outer tube). Said boring liquid is usually water. The pump must be sufficiently powerful for overcoming the important level differences between said pump and the bottom of the boring well.

In the presently known processes, the inner tube of the coring barrel can only be retrieved, in even the case of an ascending boring, by means of a cable by rather difficult operations. Thus, it is first necessary to remove completely the liquid column contained in the outer tube and to disconnect the pump from said outer tube, in order to be able to introduce the retrieving element or overshot into the outer tube. Thereafter, the pump must again be connected to the outer tube and the retrieving element must hydraulically be pushed toward the inner tube of the coring barrel, the retrieving element being automatically latched to a head of the inner tube of the coring barrel. After this step, the inner tube must be unlocked by means of a cable, upon pulling said cable. Then by winding the cable on a winch, one must bring back the inner tube from the bore hole by controlling the descent speed of said inner tube.

The presence of a cable in the known double tube coring barrels involves drawbacks during the retrieving of said inner tube, in an ascending boring.

BRIEF DESCRIPTION OF THE INVENTION

An object of the invention is to avoid the drawbacks of the known techniques for retrieving a coring barrel in a rising or ascending boring.

The invention relates to a process for retrieving, in an ascending or descending boring, a double tube coring barrel used in the presence of a boring liquid.

A particularly interesting feature of the process according to the invention is that the retrieving head itself can be used for pushing, under hydraulic pressure, the inner tube toward the end of the outer tube, which carries the drilling crown.

This invention also relates to a device for retrieving, during an ascending boring, a double tube coring barrel used in the presence of a boring liquid and comprising, within an outer tube consisting of a set of hollow rods and provided at one end with a boring crown, an inner tube equipped, at the end corresponding to said end, with a core extracting sleeve or core lifter and, at its other end, with a retrieving head and which is provided with locking means engaged, in the drilling position, in a locking annular notch or recess of the outer tube, the inner tube forming, from its upper end to its lower end, within the outer tube, a passage for the circulation of the drilling liquid toward the drilling crown. According to the invention, said retrieving device comprises means for latching it to a device for unlocking the inner tube of the coring barrel, as well as hydraulic sealing means with respect to the outer tube, said latching means and said hydraulic sealing means cooperating with each other and possibly with means belonging to the outer tube for allowing, when an ascending boring is effected, the boring liquid to flow toward the drilling crown and for causing the retrieving head to be hydraulically sealed with respect to the outer tube, when the injection of the boring liquid is interrupted.

In a particular embodiment of the device according to the invention, the retrieving head comprises a cylindrical body which may slide within the outer tube, means for latching this cylindrical body to an unlocking device allowing the sliding of the cylindrical body between two end positions with respect to the unlocking device, as well as at least one peripheral joint carried by the cylindrical body so that the retrieving head may form a sealing piston in the bore of the outer tube, whereby, in an ascending boring, the retrieving head is first in an upper position, in which the joint or joints of the retrieving head is or are maintained in front of a peripheral recess of the outer tube, so as to permit to the boring liquid to flow towards the drilling crown, during the boring, and moves into a lower second position, in which said head forms a sealing piston in the outer tube, when the injection of the drilling liquid is interrupted.

In a preferred embodiment of the device according to the invention, the retrieving head of the coring barrel comprises a cylindrical body provided with at least one peripheral joint and with a latching device which may slide with respect to the unlocking device and having a bore connecting the opposite ends of the cylindrical body, located on both sides of the peripheral joint or joints, another sliding joint which may close the part of said bore located on the opposite side with respect to the sliding latching means, a tube provided with a base plate or flange having one or more openings connecting its inner bore to the outer space and adapted for being attached to the cylindrical body on the opposite side of the sliding latching means while maintaining said other sliding joint in its position, the plate tube extending axially about an axial rod passing through the base plate and provided, at its end located inside the plate tube, with a sealing piece capable of closing the bore and, at its end located outside the plate tube, with a frusto-conical hook, a helical spring surrounding the axial rod and bearing against the plate of the plate tube and against said sealing piece.

A significant advantage of such a retrieving head is that it can be used equally with said other sliding joint for retrieving the coring barrel during an ascending boring, without overshot, nor cable, and without said other sliding joint for retrieving the coring barrel, in the usual way, with an overshot and a cable, during a substantially horizontal or descending boring.

Particularly, in such an embodiment of the device according to the invention, each of the peripheral joints is mounted on the cylindrical body downstream the unlocking device and consists of a removable ring surrounding the cylindrical body, the plate tube being threaded so that it is screwed on the cylindrical body thereby maintaining the ring against a peripheral stop of the cylindrical body, whereas the axial rod carrying said sealing piece is provided with a stop cooperating with the plate of the plate tube so as to compress said other sliding joint against the connecting bore, when the plate tube is screwed on the cylindrical body.

A sliding device according to the invention for retrieving a core barrel which can be locked in an outer tube and be unlocked by a pull comprises a cylindrical body provided with means for latching it to the unlocking device of the inner tube of the coring barrel and having a bore connecting its two ends, a ring on said cylindrical body bearing against a peripheral stop of the latter, said ring forming or carrying at least one sealing joint with the outer tube and a tube which is threaded at one of its ends, so that it can be screwed onto the cylindrical body for maintaining the ring in place, and provided at the other end with one or more openings connecting its bore to the outer space, and with a plate through which extends an axial rod itself provided, at its end located within the plate tube, with a joint for closing the bore of the cylindrical body and, at its end located outside the plate base, with a frusto-conical hook, a helical spring surrounding said axial rod and bearing against said plate and against said joint, so as to press this joint against the bore, when no pull is exerted on the frusto-conical hook. The device according to the invention for retrieving the inner tube of the coring barrel differs from the known devices by the fact that

- the means for latching the cylindrical body to the unlocking device of the inner tube of the coring barrel allows the retrieving head to slide with respect to the unlocking device between two end positions, and
- a sliding joint is used for maintaining the bore of the cylindrical body closed even when a pressure is exerted on the closure from the inside of the bore.

According to a complementary feature of the device according to the invention, said sliding joint is compressed in the closing position of the bore, when the plate tube is screwed on the cylindrical body.

DETAILED DESCRIPTION OF THE INVENTION

Other details and features of the invention will appear in the following description and the attached drawings which show, merely as non limitative examples, a few embodiments of the invention.

In these drawings:

FIG. 1 is a section of a first embodiment of a device for retrieving a coring barrel according to this invention, used in an ascending boring, the locking means of the inner tube of the coring barrel being engaged, in the boring position, in an annular locking notch and the cylindrical body of the retrieving head being in an upper position, in which the joints of the retrieving head are maintained in front of a peripheral recess of the outer tube, so as to allow the drilling liquid to flow;

FIG. 2 is a section similar to that of FIG. 1 of the device for retrieving the coring barrel shown in FIG. 1, used in an ascending boring, the means for locking the inner tube of the coring barrel being engaged in the annular locking notch, but the cylindrical body of the retrieving head being in a lower position in which said head forms a sealing piston in the outer tube, when the injection of boring liquid is interrupted;

FIG. 5 is a section similar to that of FIG. 2 of the device for retrieving a coring barrel shown in FIG. 4;

Figure 4:
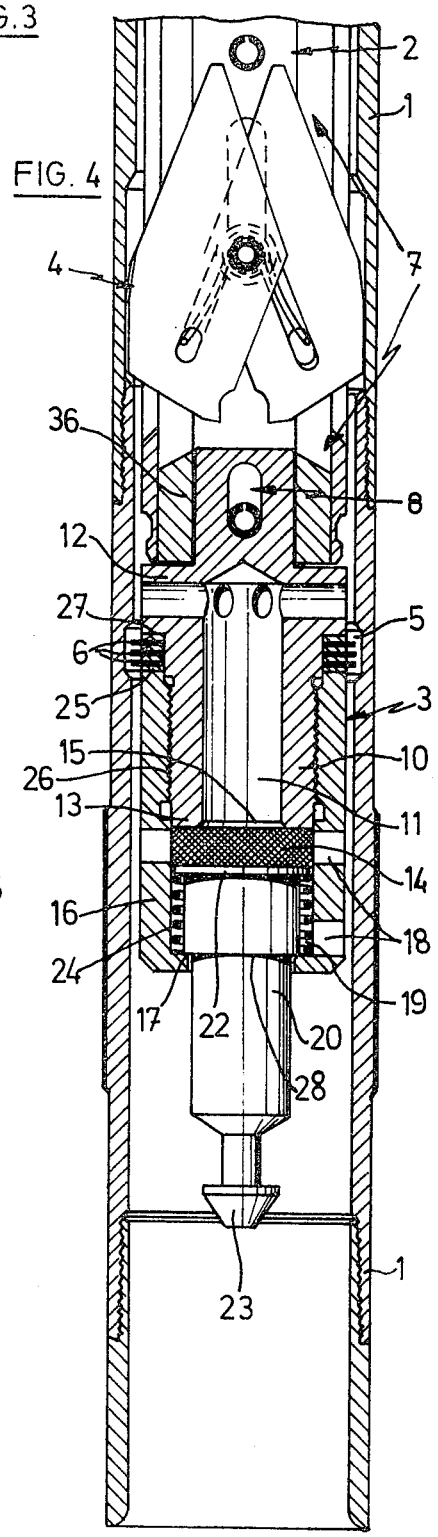
FIG. 4 is a section of another embodiment of a device for retrieving a coring barrel, when used in an ascending boring, said device being however utilizable in a substantially horizontal or descending boring.
Figure 7:
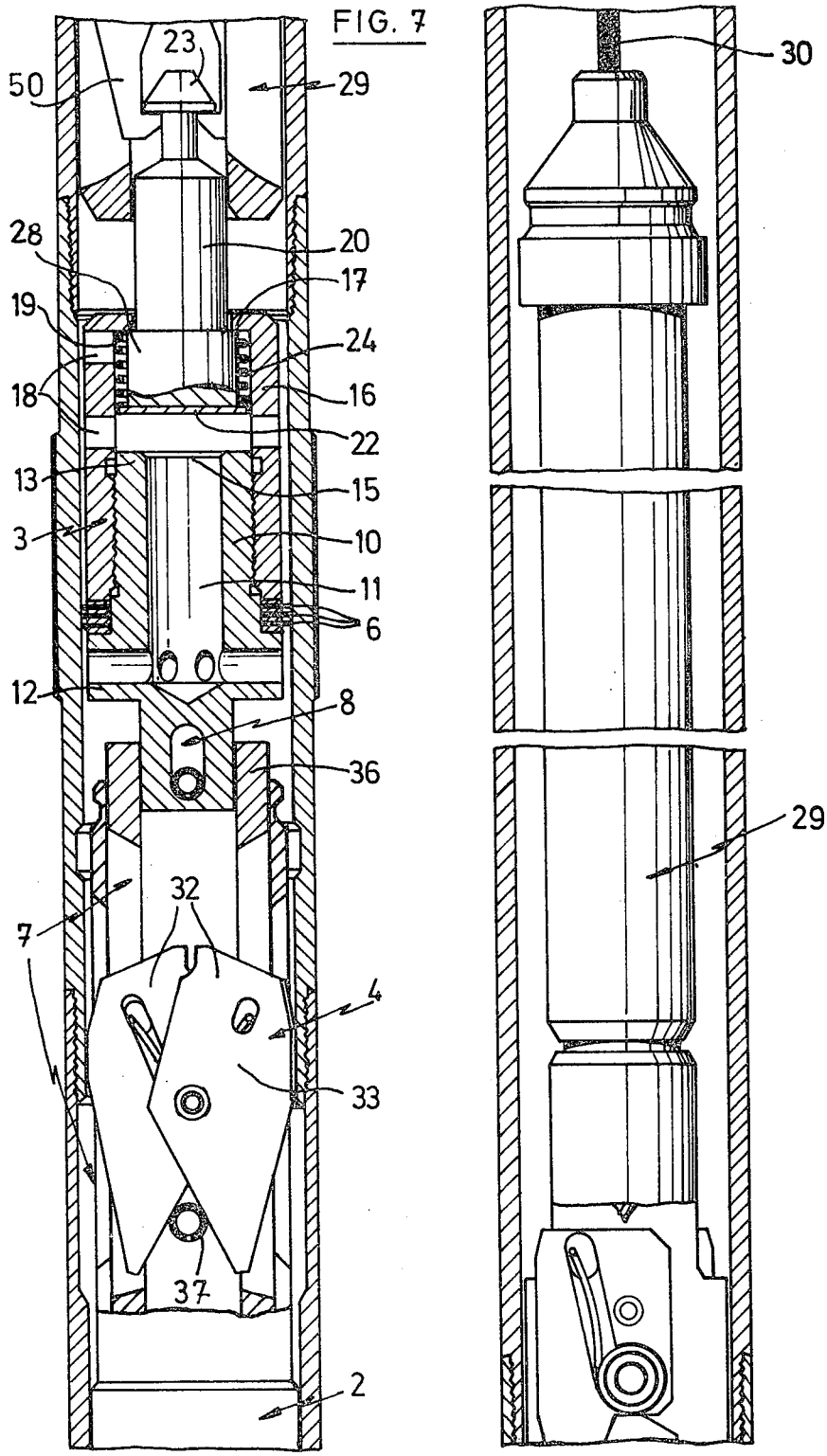

FIG. 6 is a section of the device for retrieving a coring barrel shown in FIGS. 4 and 5, when used in a descending boring, the means for locking the inner tube of the coring barrel being engaged, in the boring position, in an annular locking notch and the cylindrical body of the retrieving head being in a lower position, the joints of the retrieving head being maintained in front of a peripheral recess of the outer tube, so as to allow the circulation of the boring liquid, and FIG. 7 is a section similar to that of FIG. 6 showing the coring barrel represented in FIGS. 4 to 6 when it is retrieved, during a descending boring, by means of an overshot and a cable.

In these figures, the same numbers designate identical or equivalent elements.

Figure 1:
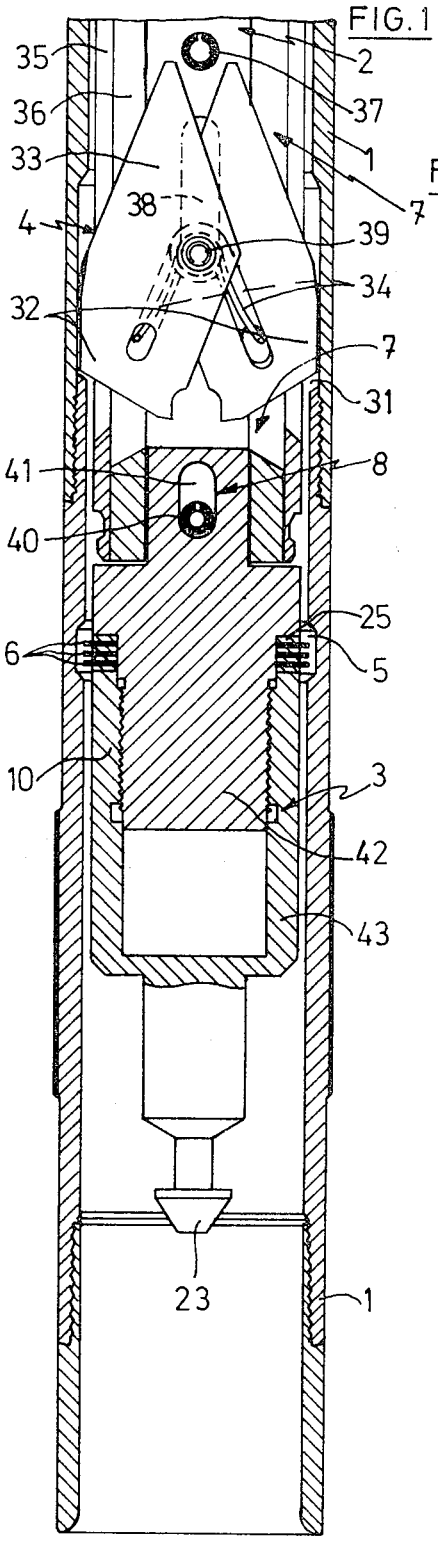
Figure 2:
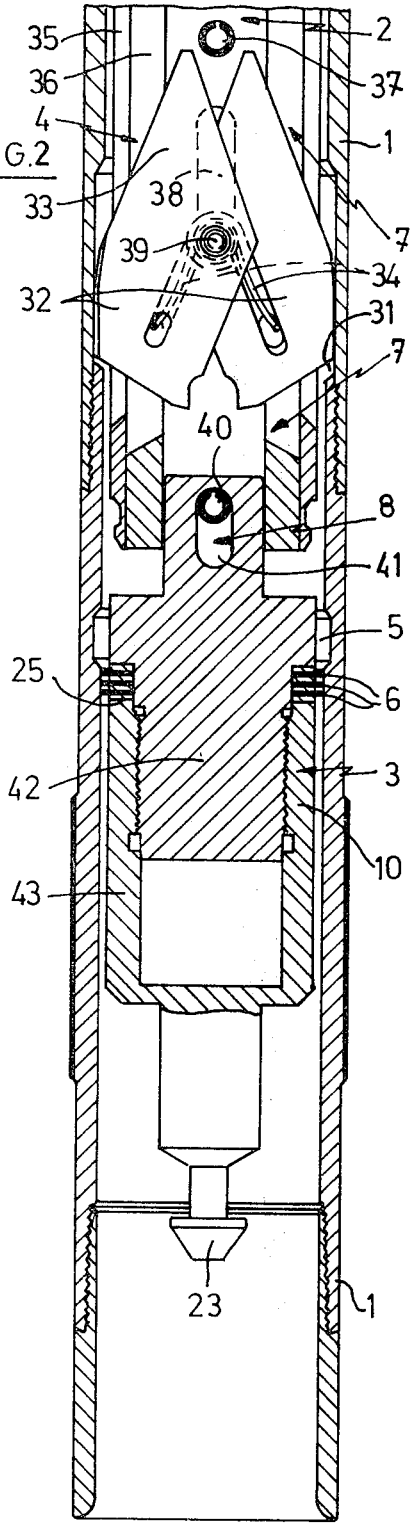
Figure 3:
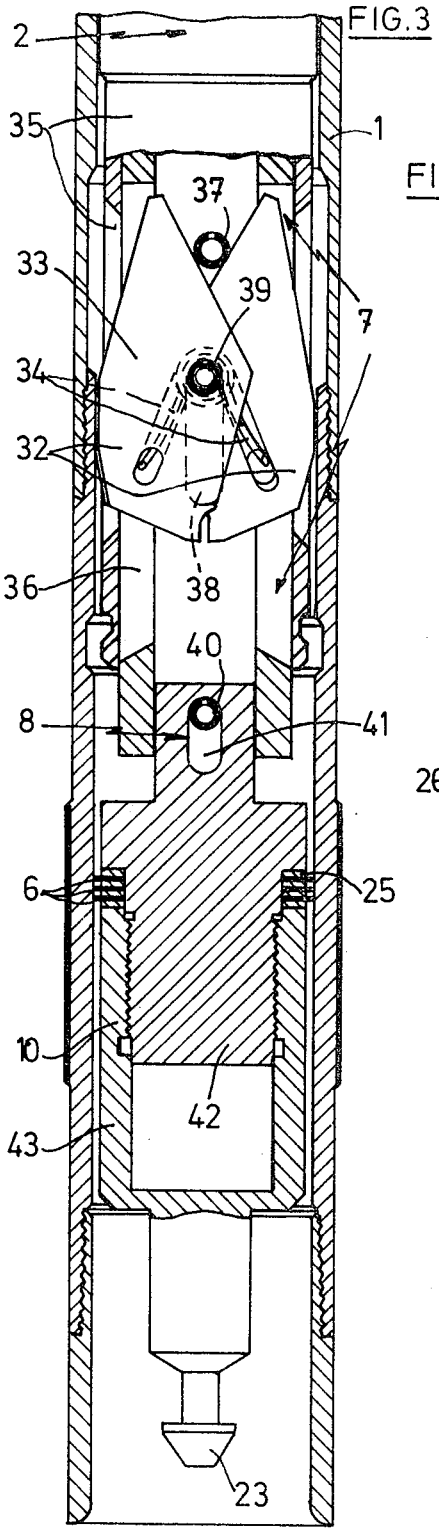
FIG. 3 is a section similar to that of FIGS. 1 and 2 showing the device for retrieving the coring barrel, when used in an ascending boring, the means for locking the inner tube of the coring barrel having been unlocked.

FIGS. 1 to 3 show a first embodiment of the device for retrieving the inner tube of a coring barrel according to this invention.

The coring barrel used in an ascending boring comprises essentially an inner tube 2 which may slide within an outer tube 1 and is provided with a retrieving head 3 according to a first embodiment of the invention.

The inner tube 2 and the retrieving head 3 are locked (FIGS. 1 and 2) in the outer tube 1, by means of a locking device 4 fastening in a peripheral groove 31 of the outer tube, by the feet 32 of a latch 33, outwardly urged by a spring 34.

The unlatching of this locking device 4 is caused by a sliding device 7 consisting of a tubular latch carrier 35 integral with the inner tube and of an unlatching slide 36 which carries an unlatching pin 37 and may slide in the tubular latch carrier 35.

When a pull is exerted onto the unlatching slide 36, the latter moves, with respect to the latch carrier 35 and to the latch 33, on a distance corresponding to the sliding recess 38 in said slide 36, thereby moving the axis 39 of attachment of the latch 33.

The pin 37 removes thus the feed 32 of the latch 33 from the latching groove 31. The retrieving head 3 is connected to said slide 36 by means of a latching device 8 consisting of a pin 40 fixed to the slide 36 and introduced in an elongated recess 41 in the end of the retrieving head 3. In the embodiment shown in FIGS. 1 to 3, said retrieving head 3 consists of a cylindrical body 10 comprising two cylindrical elements 42 and 43 screwed on each other with a ring 25 therebetween, said ring 25 being provided with peripheral joints 6 capable of forming a sealing joint with respect to the bore of the outer tube 1. The retrieving head 3 may moreover comprise a frusto-conical hook 23 which allows, for example, the hooking of a retrieving piece provided with a cable, if necessary.

The device for retrieving the inner tube of the coring barrel according to the invention is used as follows:

During an ascending boring, the inner tube 2 of the coring barrel is latched in the outer tube 1, the retrieving head 3 being in the position shown in FIG. 1.

The retrieving head 3 is maintained in said upper position by the hydraulic pressure exerted by the boring liquid which is sent, under pressure, toward the boring crown.

The peripheral joints 6 are thus maintained in front of a peripheral recess 5 in the bore of the outer tube 1, so as to allow the boring liquid to pass.

When the injection of the boring liquid is interrupted, the retrieving head 3 moves by gravity toward a lower position shown in FIG. 2, so that the peripheral joints 6 sealingly contact the bore of the outer tube and the back end of the elongated recess 41 bears on the pin 40 of the slide 36.

When the boring liquid column is released at the bottom of the outer tube, by means of a discharge valve (not shown) mounted on a branch of the pipe connecting the pump to the outer tube of the coring barrel, the liquid column contained in the inner tube exerts a brutal pull on the retrieving head 3 acting as a piston and this pull is transferred to the unlatching slide 36 through the pin 40.

The unlatching pin 37 thus acts onto the latch 33, so as to remove the feet 32 from the groove 31 and to release the inner tube 2. The inner tube 2 starts then to descend in the outer tube 1 (see FIG. 3) under the influence of its own weight and of the depression created by the boring liquid column. The device descends together with the liquid column. The descent speed of the liquid column is controlled by adjusting the flow of the discharge valve. This adjustment allows a smooth retrieval of cores, shocks which might affect the quality of these cores being avoided.

FIGS. 4 and 5 show a second embodiment of the device for retrieving coring barrels according to the invention, in an ascending boring. The operation of the device is exactly the same as that of the device described with reference to FIGS. 1 to 3.

The retrieving device is however different, since this device can be used both for retrieving the coring barrel without overshot or cable in an ascending boring and for retrieving the coring barrel in a horizontal or descending boring.

This device comprises a cylindrical body 10 and a tube 16 having a base plate or flange 17, said tube 16 being screwed (26) on the cylindrical body, a ring 25 provided with peripheral joints 6 being compressed between the body 10 and the tube 16.

The cylindrical body 10 is connected to the unlatching slide 36 by means of a latching device 8 and is provided with a bore 11 connecting its two ends 12, 13.

During the use, in an ascending boring, in the device for retrieving a coring barrel according to the invention, said bore 11 connecting the two ends 12, 13 of the cylindrical body, located on both sides of the peripheral joints 6, is closed by a sliding joint 14. This sliding joint 14 is maintained in place in the cavity of the tube 16 by an axial rod 20 extending through said tube 16, one end 22 of which bears against said sliding joint 14 and a stop 28 of the axial rod 20 bearing, on the other side, against the base plate or flange 17 of the tube 16.

In the shown position of the device, in which the sliding joint 14 closes the bore 11 connecting the ends 12, 13 of the cylindrical body 10, the boring liquid cannot flow inside said cylindrical body 10, through openings 18 provided in the tube 16 provided with the base plate 17.

In this use position, the device has thus exactly the same function as the device described above with reference to FIGS. 1 to 3. This means that, during the boring, the boring liquid may flow through a peripheral recess in the bore of the outer tube 1 (FIG. 4) and that, when the hydraulic pressure of the boring liquid is interrupted, the device descends toward the lower position, in which the peripheral joints 6 sealingly contact the bore of the outer tube (FIG. 5).

FIGS. 6 and 7 illustrate the use of the device according to the invention for the retrieval of an inner tube of the coring barrel in the usual manner with an overshot 29 and a cable 30, in a descending boring.

In this mode of use, the device according to the invention is used without the sliding closing joint 14 for the bore 11 in the cylindrical body 10. In the boring position (FIG. 6), the inner tube 2 of the coring barrel is latched in the outer tube by the locking device 4.

A spring 24 bearing against the base plate 17 of the tube 16 and against the stop 18 of the axial rod 20 applies the end having the shape of a closing joint 22 of said rod against the bore between the ends 12, 13 of the cylindrical body 10. During a descending boring, the retrievind head 3 drives the sliding hooking device 8 in a lower position, due to the hydraulic pressure of the boring liquid and to the weight of the retrieving head. The boring liquid can thus flow toward the boring crown through the peripheral recess 5 of the bore of the outer tube.

For the retrieval of the coring barrel, an overshot 29 is lowered into the outer tube 1 by means of a cable 30.

When the overshot 29 reaches the retrieving head 3, a hooking grip 50 of the overshot engages the frusto-conical hook 23 of the retrieving head.

When a pressure is then exerted on the cable 30, the grip 50 moves the axial rod 20 against the spring 24. The rod 20 then bears against the base plate 17 of the tube 16 through its stop 28, so that the retrieving head 3 is driven upwardly until it reaches a position wherein the peripheral joints 6 sealingly contact the bore of the outer tube 1.

Due to the removal of the closing joint 22 from the bore 11 of the cylindrical body with the axial rod 20, the boring liquid column located above the retrieving head 3 and the peripheral sealing joints 6 thereof may flow through the openings 18 of the tube 16 and the bore 11 of the cylindrical body 10, when the inner tube is driven upwardly.

When the retrieving head has reached the upper position of the latching or hooking device 8 with respect to the unlatching device 7, the upward movement of the cable 30 and of the overshot 29 drives the unlatching slide upwardly, so that the feet 32 of the latch 33 are released by the pin 37 (FIG. 7), thus allowing the upward motion of the inner tube 1.

The invention is obviously not limited to the above described embodiments which may be modified without departing from the scope of the invention as defined in the following claims.

What is claimed is:

1. A process for retrieving a double tube coring barrel including an outer tube (1) and an inner tube (2) which is pushed into a desired position, in an ascending boring, by a column of water acting on a sealing piston within the outer tube, the pressure in a lower part of the column being regulated above the hydrostatic pressure increased by the weight of said inner tube until said desired position is reached, comprising the steps of: increasing the pressure to circulate boring liquid toward a drilling crown and thereby take a core sample in the coring barrel, reducing the pressure in the lower part of the column to allow a retrieving head (3) to drop by gravity and seal off the outer tube, unclamping the inner tube of the coring barrel from the outer tube by allowing boring liquid in an upper part of the column to exert a traction force on the retrieving head, and allowing the unclamped inner tube and core sample to slide by gravity down through the outer tube to a retrieval site by draining boring liquid from the lower part of the column.

2. A process according to claim 1, in which the retrieving head is connected to an unlatching device of the inner tube of the coring barrel by a sliding hook means, and is movable between an upper position in which a passage for the flow of the boring liquid toward the boring crown is open, and a lower position for the retrieval of the inner tube whereat the retrieving head forms a sealing piston within the outer tube.

3. A process according to claim 1, in which the retrieving head is used for pushing, under hydraulic pressure, the inner tube toward the end of the outer tube, which carries the drilling crown.

4. A device for retrieving, during an ascending boring, a double tube coring barrel used in the presence of a boring liquid, comprising: within an outer tube (1) consisting of a set of hollow pipes and provided at one end with a boring crown, an inner tube (2) equipped, at an end corresponding to said one end, with a core extracting sleeve and, at its other end, with a retrieving head (3) and provided with locking means (4) engaged, in a drilling position, in an annular recess (31) of the outer tube, the inner tube forming, from its upper end to its lower end, within the outer tube, a passage for the circulation of drilling liquid toward the drilling crown, said retrieving head comprising means (40) for latching it to a device (7) for unlocking the inner tube of the coring barrel, and hydraulic sealing means on the retrieving head (6) for sealing off the outer tube to enable the gravity descent and retrieval of the unlocked inner tube and core sleeve upon a reduction of the boring liquid pressure and a draining of said liquid from a lower portion of the barrel.

5. A device according to claim 4, in which the retrieving head comprises a cylindrical body which may slide within the outer tube, means for latching this cylindrical body to an unlocking device allowing the sliding of the cylindrical body between two end positions with respect to the unlocking device, as well as at least one peripheral joint carried by the cylindrical body so that the retrieving head may form a sealing piston in the bore of the outer tube, whereby, in an ascending boring, the retrieving head is first in an upper position, in which the joint or joints of the retrieving head is or are maintained in front of a peripheral recess of the outer tube, so as to permit to the boring liquid to flow towards the drilling crown, during the boring, and moves into a lower second position, in which said head forms a sealing piston in the outer tube, when the injection of the drilling liquid is interrupted.

6. A device according to claim 4, in which the retrieving head of the coring barrel comprises a cylindrical body provided with at least one peripheral joint and with latching means which may slide with respect to the unlocking device and having a bore connecting the opposite ends of the cylindrical body, located on both sides of the peripheral joint or joints, another sliding joint which may close the part of said bore located on the opposite side with respect to the sliding latching means, a tube provided with a base plate or flange having one or more openings connecting its inner bore to the outer space and adapted for being attached to the cylindrical body on the opposite side of the sliding latching means while maintaining said other sliding joint in its position, the plate tube extending axially about an axial rod passing through the base plate and provided, at its end located inside the plate tube, with a sealing piece capable of closing the bore, and, at its end located outside the plate tube, with a frusto-conical hook, a helical spring surrounding the axial rod and bearing against the plate of the plate tube and against said sealing piece, said retrieving head being equally utilizable with said other sliding joint for retrieving the coring barrel during an ascending boring, without an overshot, nor a cable, and without said other sliding joint for retrieving the core barrel, in the usual way, with an overshot and a cable, during a substantially horizontal or descending boring.

7. A device according to claim 6, in which each of the peripheral joints is mounted on the cylindrical body downstream the unlocking device or consists of a removable ring surrounding the cylindrical body;

said tube provided with a base plate is threaded so that it is screwed on the cylindrical body thereby maintaining the ring against a peripheral stop of the cylindrical body, said axial rod carrying said sealing piece is provided with a stop cooperating with the plate of the plate tube so as to compress said other sliding joint against the connecting bore, when the plate tube is screwed on the cylindrical body.

8. A device according to claim 6, in which the retrieving head comprises, on the one hand, the means for latching the cylindrical body to the unlocking device of the coring barrel, which allows the sliding of the retrieving head with respect to the unlatching device between two extreme positions and, on the other hand, the other sliding joint for maintaining said bore of the cylindrical body closed, even when a pressure is exerted on the closure inside the bore.

9. A device according to claim 8, in which said other sliding joint is maintained in the closing position of said bore when the base plate is screwed on the cylindrical body.

* * * * *